US008585348B2

(12) United States Patent
Lin et al.

(10) Patent No.: US 8,585,348 B2
(45) Date of Patent: Nov. 19, 2013

(54) CENTRIFUGAL COMPRESSOR WITH PIPE DIFFUSER

(75) Inventors: Frank Lin, Torrance, CA (US); Adonis Spathias, Glendora, CA (US)

(73) Assignee: Honeywell International, Inc., Morristown, NJ (US)

( * ) Notice: Subject to any disclaimer, the term of this patent is extended or adjusted under 35 U.S.C. 154(b) by 1009 days.

(21) Appl. No.: 12/637,650

(22) Filed: Dec. 14, 2009

(65) Prior Publication Data

US 2011/0142609 A1 Jun. 16, 2011

(51) Int. Cl.
*F04D 29/44* (2006.01)

(52) U.S. Cl.
USPC ..... 415/1; 415/208.3; 415/211.2

(58) Field of Classification Search
USPC ..... 415/208.3, 204.5, 211.2, 224.5, 1
See application file for complete search history.

(56) References Cited

U.S. PATENT DOCUMENTS 3,333,762 A * 8/1967 Vrana ..... 415/207
3,420,435 A * 1/1969 Kenny et al. ..... 415/207
3,876,328 A * 4/1975 Exley ..... 415/208.3
3,936,223 A * 2/1976 Baghdadi ..... 415/208.4
3,964,837 A * 6/1976 Exley ..... 415/181
4,966,523 A * 10/1990 Sherikar ..... 415/208.4
5,145,317 A * 9/1992 Brasz ..... 415/224.5
5,266,002 A * 11/1993 Brasz ..... 415/208.3
6,099,168 A * 8/2000 Sishtla ..... 384/549
6,537,028 B1 * 3/2003 Izumi et al. ..... 415/208.3
7,281,379 B2 * 10/2007 Brasz ..... 60/616
7,326,027 B1 * 2/2008 Skoch et al. ..... 415/17
2003/0059301 A1 * 3/2003 Izumi et al. ..... 415/208.3

FOREIGN PATENT DOCUMENTS

JP 8093694 4/1996

* cited by examiner

*Primary Examiner* — Edward Look
*Assistant Examiner* — Aaron R Eastman
(74) *Attorney, Agent, or Firm* — Shimokaji & Assoc., P.C.

(57) ABSTRACT

A centrifugal compressor may comprise a wheel and a pipe diffuser. The pipe diffuser may comprise an annular pipe diffuser section and at least one cylindrical hole passing through the annular pipe diffuser section for compressing gas emerging from the wheel. The at least one cylindrical hole may have an axis that is slanted at an angle A relative to a plane that is orthogonal to an axis of rotation of the compressor.

20 Claims, 9 Drawing Sheets

CENTRIFUGAL COMPRESSOR WITH PIPE DIFFUSER

BACKGROUND OF THE INVENTION

The present invention generally relates to centrifugal compressors and, more particularly, to centrifugal compressors with pipe diffusers.

Centrifugal gas compressors may be employed in numerous applications which may benefit from compact size of the compressor and a relatively low cost. It may be desirable to provide compact and low cost compressors in vehicles. For example, centrifugal compressors may be used as turbochargers in automotive applications or as air compressors in environmental control systems of aircraft.

A typical centrifugal compressor may employ a vaned wheel to draw gas from an inlet and accelerate the gas. As high-velocity gas emerges from an outlet of the wheel, the gas may enter a diffuser in which its velocity may be decreased and its static pressure may be increased. As the gas emerges from the diffuser, it may be in a compressed state.

Some centrifugal compressors may employ diffusers with vanes that form channels for reduction of gas velocity. These are known as vaned diffusers. Other centrifugal compressors may employ a solid diffuser in which tapered cylindrical openings act as velocity reduction channels. These tapered cylindrical openings are typically referred to as pipes. A diffuser which employs pipes is referred to as a pipe diffuser.

A typical pipe diffuser may be produced less expensively than a typical vaned diffuser. Consequently, it is desirable to build vehicular centrifugal compressors with pipe diffusers rather than vaned diffusers. The advantageously lower cost of a pipe diffuser has evolved largely as a result of fact that pipe diffusers may be fabricated from a single piece of metal with conventional machining techniques. While it is desirable to produce a centrifugal compressor at a low cost, it also important to assure that the centrifugal compressor may operate efficiently. It has been found that a smooth and controlled transition of gas from the wheel into the diffuser pipes is a key feature for providing high efficiency.

Referring now to FIG. 1, a cross-sectional view of a conventional centrifugal compressor 10 illustrates a relationship between a wheel 12 and a diffuser 14. The diffuser 14 may comprise an annular pipe diffuser section 14-2 and an integral shroud 14-4. In the compressor 10, a transition region 16 may exist between outer extremities of blades 12-2 of the wheel 12 and inlets 18-2 of pipes 18 of the diffuser 14. Gas 20 may enter the compressor 10 through an inlet 22. Rotation of the wheel 12 may accelerate the gas 20 along the blades 12-2 and drive the gas 20 toward the diffuser 14. The gas 20 may decelerate in the diffuser 14 as the gas 20 passes through the pipes 18. Passage of the gas through the pipes 18 may result in an increase in static pressure of the gas 20.

A design of the compressor 10 may be modeled mathematically to optimize its operational features. Such mathematical modeling may, for example, seek to minimize energy applied to the wheel 12 while maximizing static pressure produced in the pipes 18. In the context of the modeling, consideration may be given to a shape of the blades 12-2, a shape of the pipes 18 and also a shape of the transition region 16. After a mathematical model has been completed, resultant shapes for the blades 12-2 and the pipes 18 may be implemented with conventional fabrication techniques. For example, the wheel 12 and its blades 12-2 may be produced as a single metal casting. The pipes 18 of the diffuser 14 may be produced by conventional machining techniques such as drilling and honing.

Referring now to FIGS. 2 and 3, it may be seen that a mathematically defined shape of the transition region 16 shown in FIG. 1 may not be readily producible with conventional metal fabrication techniques. FIG. 2 illustrates a portion of the diffuser 14 during a fabrication step in which one of the pipes 18 may be produced as a hole in the annular pipe diffuser section 14-2 with a drill (not shown) and a honing tool 24. The honing tool 24 may produce a tapered hollow cylindrical shape for the pipe 18. In order to provide a complete shaping of any one of the pipes 18, the honing tool 24 may be required to project beyond an inner extremity or inlet 18-2 of the pipe 18 as illustrated in FIG. 2. When the honing tool 24 extends beyond the inlet 18-2, the tool 24 may produce tool marks or indentations 26 in the shroud 14-4 of the diffuser 14 as shown in FIG. 3. The honing tool 24 may also produce indentations 28 in a backplane 14-6 of the diffuser 14. The indentations 26 and 28 may result in a transition region 16' having a shape that may be inconsistent with its mathematical model. Thus a configuration of the transition region 16' of FIG. 3 may differ from a shape of transition region 16 of FIG. 1.

Referring now to FIG. 4, a collective effect of the indentations 28 may be seen. FIG. 4 may represent a cross-section of a portion of the diffuser 14 taken in a direction of the backplane 14-6. A dashed-line circle 30 may represent a desired radius at which the inlets 18-2 of the pipes 18 are to be located. The indentations 28 may produce an irregular surface on the backplane 14-6 of the transition region 16'.

As can be seen, there is a need to provide high efficiency in a centrifugal compressors with pipe diffusers even though the diffuser may be produced with low-cost fabrication techniques. In that regard there is a need to tailor compressor design to accommodate low cost fabrication techniques in order to optimize compressor efficiency and cost of fabrication.

SUMMARY OF THE INVENTION

In one aspect of the present invention, a centrifugal compressor may comprise a wheel and a diffuser comprising an annular pipe diffuser section; at least one cylindrical hole passing through the annular pipe diffuser section for compressing gas emerging from the wheel; and; the at least one cylindrical hole having an axis that is slanted at an angle A relative to a plane that is orthogonal to an axis of rotation of the compressor.

In another aspect of the present invention, a method for producing a centrifugal compressor may comprise the steps of producing pipes in an annular pipe diffuser, having an integral shroud, so that axes of the pipes slant at an angle A relative to a plane that is orthogonal to an axis of the compressor; positioning the pipe diffuser around a wheel; wherein a portion of the shroud forms a first boundary of a transition region between the wheel and the annular pipe diffuser; and wherein the first boundary is free of any indentations resulting from the step of producing the pipes.

In a further aspect of the present invention, a method for producing a pipe diffuser for a centrifugal compressor may comprise the steps of producing an annular diffuser integrally with a shroud; and producing pipes through the annular diffuser with axes of the pipes slanted relative to a plane that is orthogonal to an axis of the compressor and so that the pipes are produced without producing tool marks on the shroud.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a centrifugal compressor with a pipe diffuser in which a transition region between a wheel and the diffuser is not adversely distorted by fabrication steps.

Figure 1:
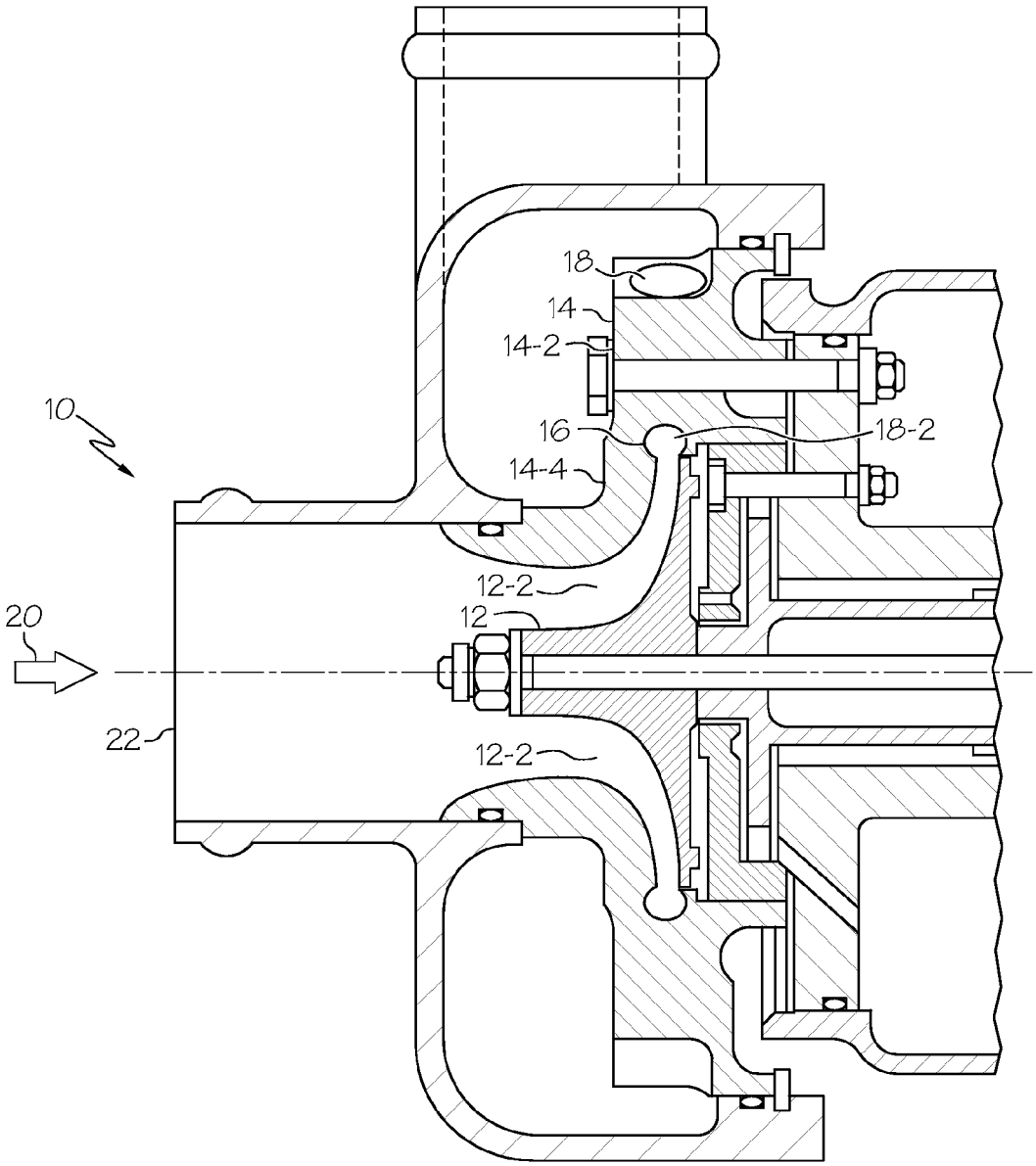
FIG. 1 (PRIOR ART)
FIG. 1 is a partial sectional elevation view of a centrifugal compressor in accordance with the prior art.
Figure 2:
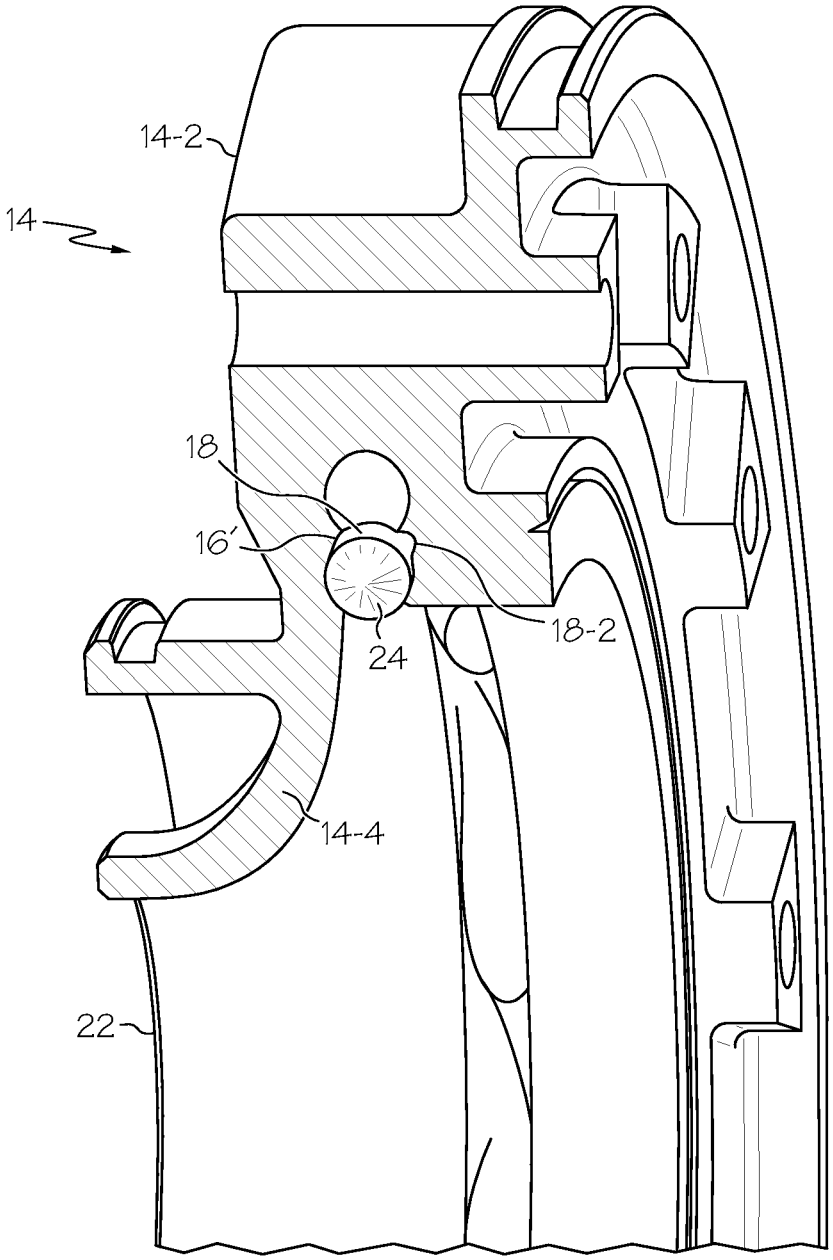
FIG. 2 (PRIOR ART)
FIG. 2 is an isometric view of a cut-away portion of a diffuser of the compressor of FIG. 1 in accordance with the prior art.
Figure 5:
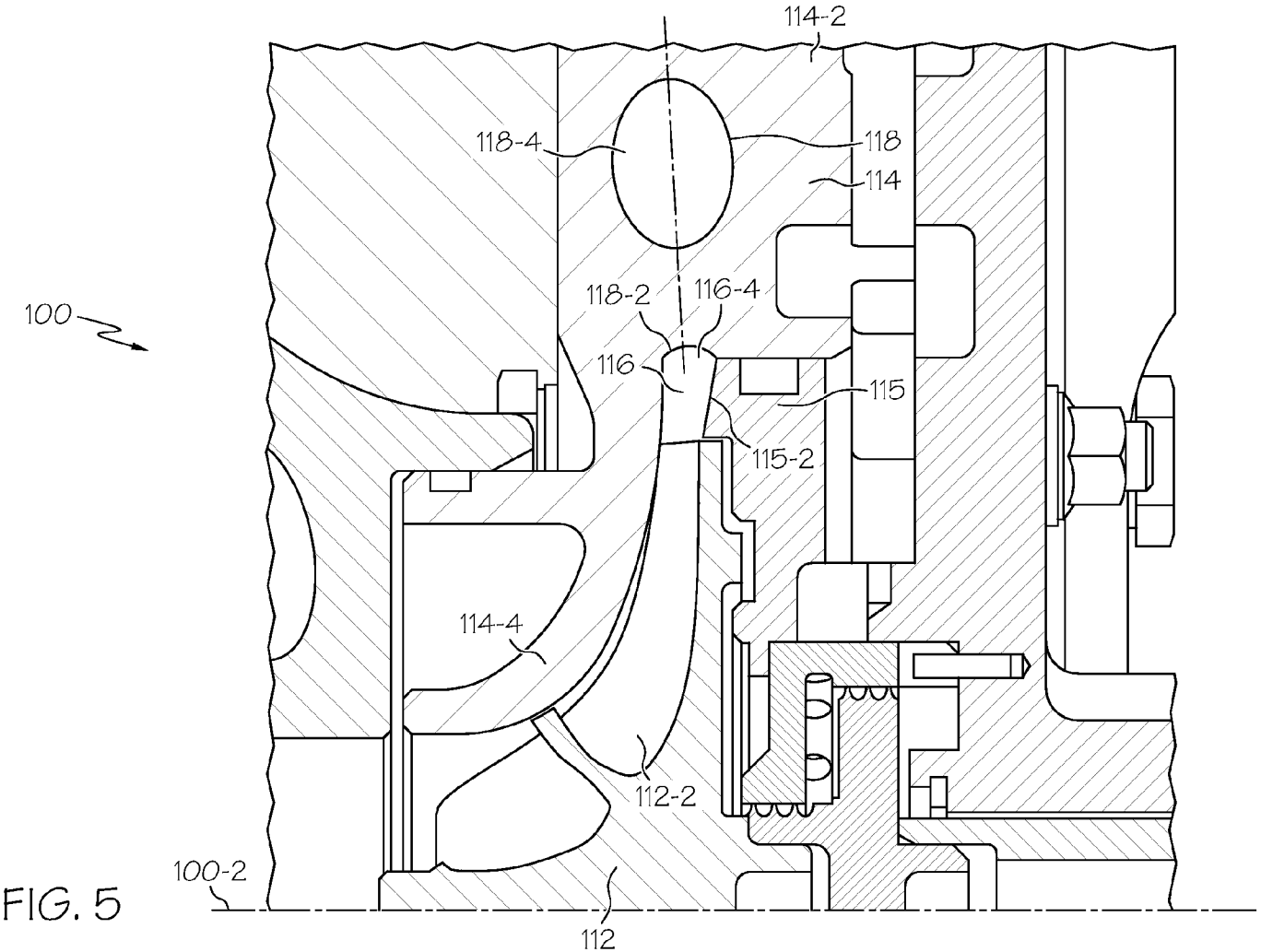
FIG. 5 is a partial sectional elevation view of a centrifugal compressor in accordance an embodiment of the present invention.
Figure 6:
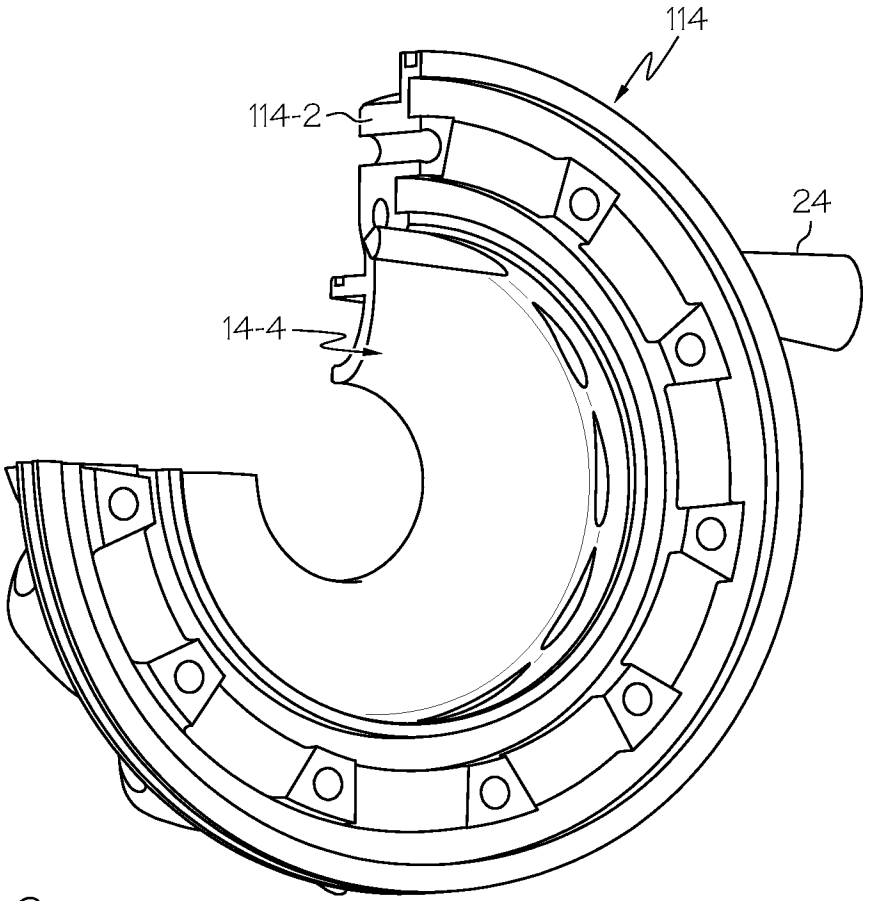
FIG. 6 is an isometric view of a cut-away portion of a diffuser of the compressor of FIG. 5 in accordance with an embodiment of the present invention.

Referring now to FIG. 5, a partial sectional view of a compressor 100 illustrates a design in which a transition region 116 may retain a desired mathematically modeled shape after pipes 118 are honed. In the compressor 100, a diffuser 114 may be constructed with an annular pipe diffuser section 114-2 and an integral shroud 114-4. Pipes 118 may be formed as tapered holes in the annular pipe diffuser section. The pipes 118 may have axes 118-4 oriented in a non-orthogonal relationship with an axis 100-2 of the compressor 100. Additionally, the compressor 100 may be constructed so that a backplane 115-2 of the transition region 116 may be incorporated on a backplate 115 of the compressor 100. In other words, unlike the backplane 14-6 of the diffuser 14 of prior art FIG. 1, the backplane 115-2 may be separate from the diffuser 114.

Referring now to FIGS. 5 through 8, advantages of these structural features may be understood. In FIG. 5, it may be seen that the honing tool 24 may pass to a position adjacent the shroud 114-4 without contacting the shroud. Consequently, undesirable tool marks or indentations in the shroud 114-4 may be avoided. When indentations are avoided, the transition region 116 may remain free of distortions. This may be readily understood by referring to FIG. 6 in which it may be seen that the honing tool 24 may produce no tool marks on the shroud 114-4.

Figure 3:
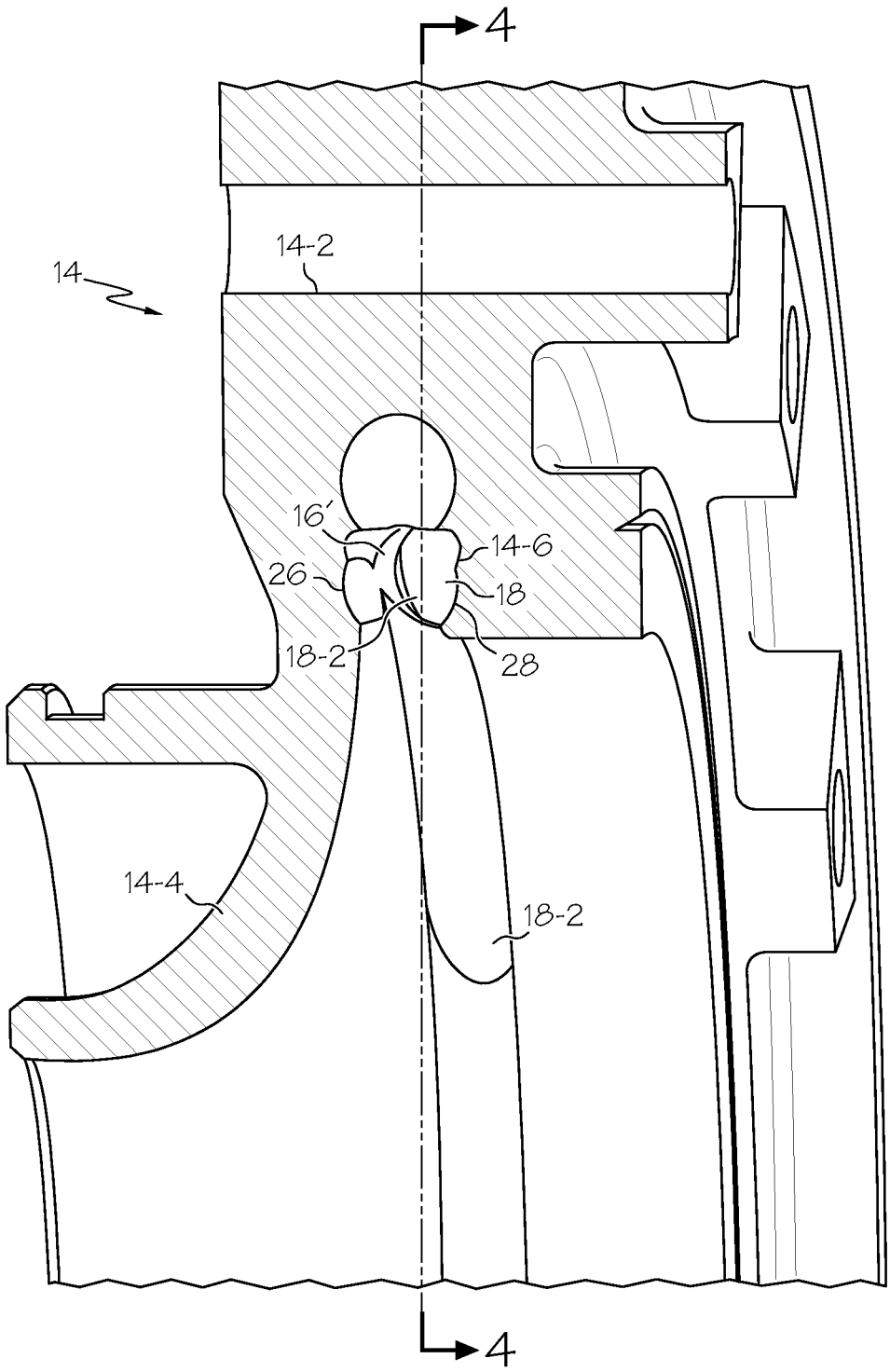
FIG. 3 (PRIOR ART)
FIG. 3 is an isometric view of portion of the diffuser of FIG. 2 illustrating tool marks in accordance with the prior art.
Figure 4:
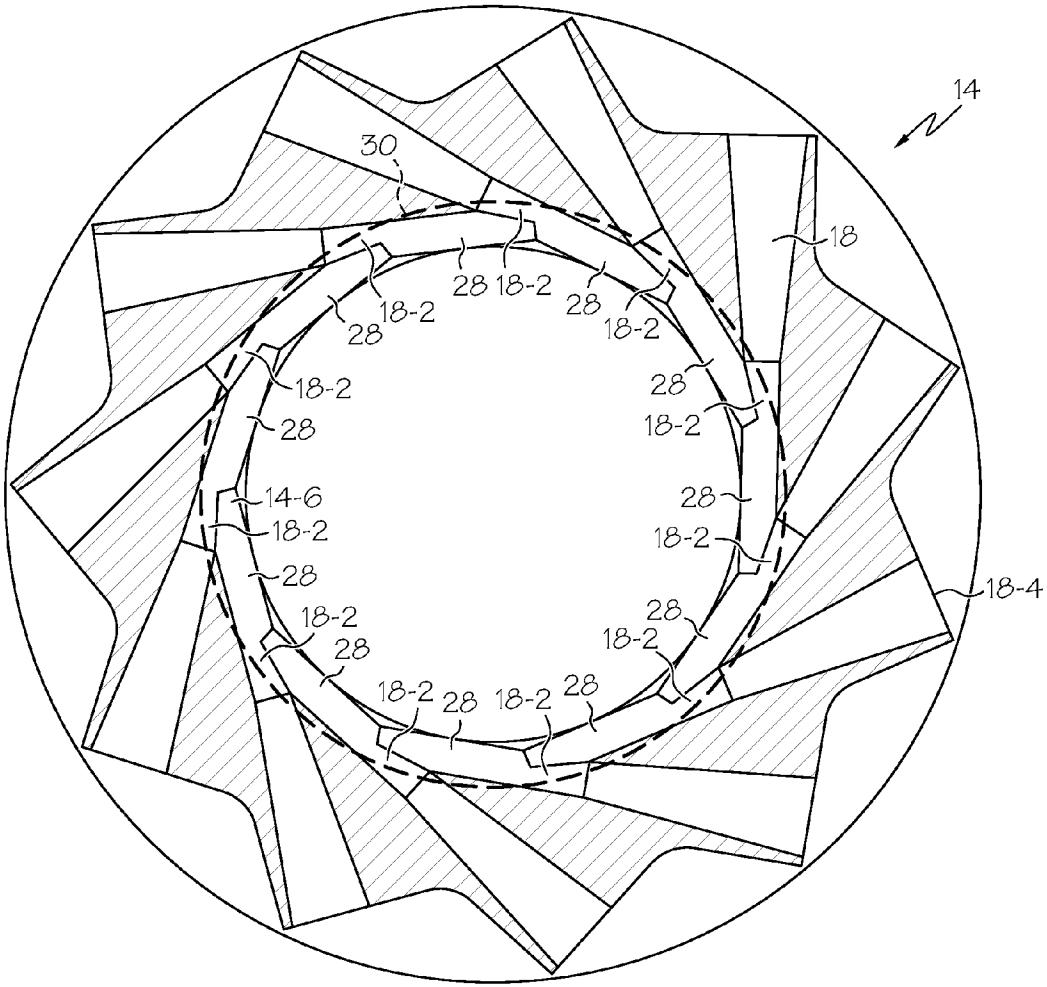
FIG. 4 (PRIOR ART)
FIG. 4 is a sectional view of the diffuser of FIG. 3 taken along the section line 4-4 in accordance with the prior art.
Figure 7:
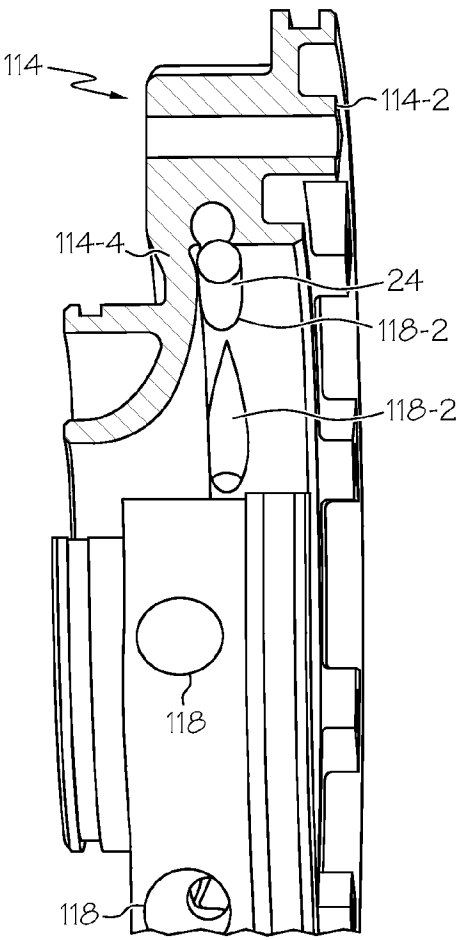
FIG. 7 is an isometric view of a cut-away portion of the diffuser of FIG. 6, illustrating a honing tool in operation, in accordance with an embodiment of the present invention.
Figure 9:
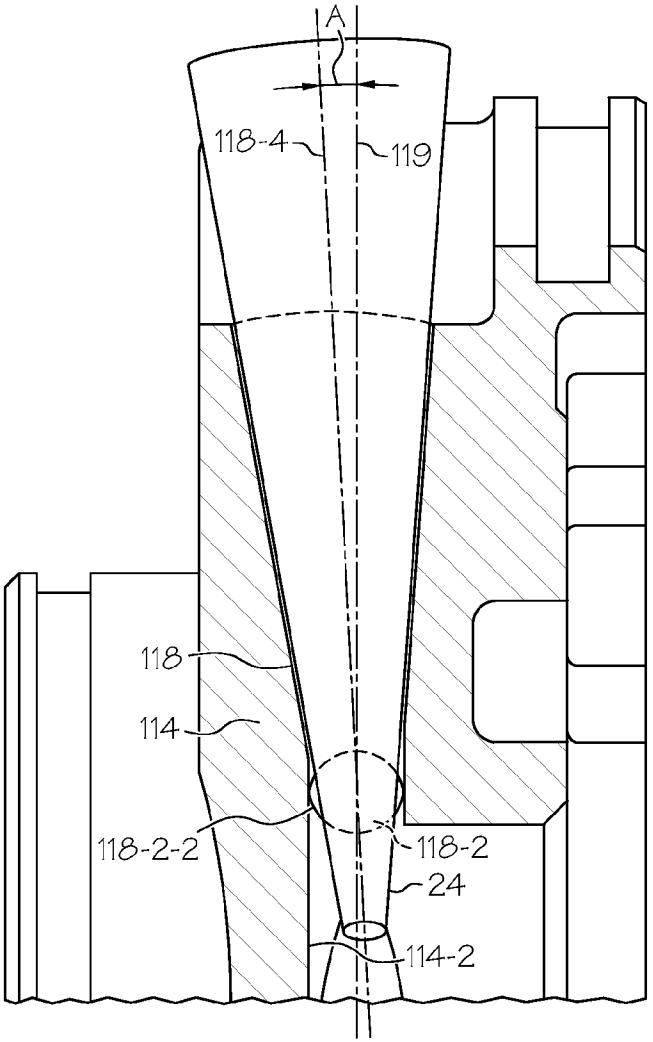
FIG. 9 is a sectional view of the diffuser of FIG. 8 taken through a pipe of the diffuser in accordance with an embodiment of the present invention.

FIG. 7 also illustrates a portion of the diffuser 114 and the shroud 114-4 which partially comprise the transition region 116. It may be noted that the shroud 114-4 may not be distorted with any indentation such as the indentations 26 of prior art FIG. 3.

Figure 8:
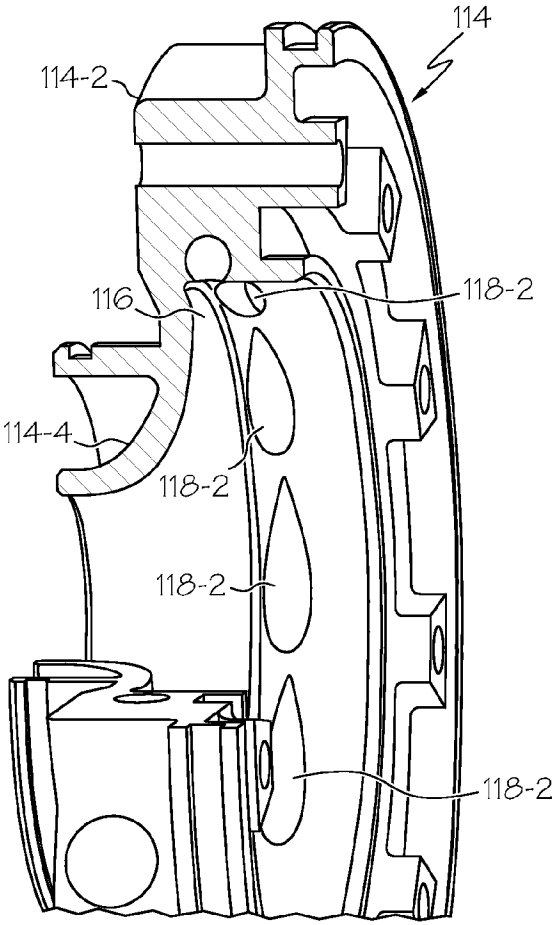
FIG. 8 is an isometric view of the cut-away portion of the diffuser of FIG. 7, with the honing tool removed, in accordance with an embodiment of the present invention.

This feature of an embodiment of the present invention may be further understood by referring to FIG. 8. FIG. 8 shows a partial sectional view through one of the pipes 118. It may be seen that the axis 118-4 of the pipe 118 is oriented at an angle A relative to a hypothetical plane 119 which may be orthogonal to the axis 100-2 of the compressor 100 of FIG. 5. The honing tool 24 of FIG. 6 may pass through the pipe 118 without contacting the shroud 114-4. Consequently, the shroud 114-4 may remain free of indentations such as the indentations 26 of prior art FIG. 3.

Referring back now to FIG. 5, it may be noted that the backplate 115 may be a compressor component separate from the diffuser 114. The backplate 115 may be produced independently from production of the diffuser 114. Consequently, the honing tool 24 may pass through the pipes 118 without contacting the backplate 115. Thus the backplate 115 may remain free of indentations such as the indentations 28 of prior art FIG. 3. The compressor 100 may be assembled as shown in FIG. 5 with the transition region 116 configured in accordance with a desired shape that is consistent with mathematical modeling. In other words, there may be no distortions of the transition region boundaries (i.e., the shroud 114-4 and the backplane 115-2) resulting from indentations such as tool marks from the honing tool 24.

It may also be seen that the transition region 116 may be produced with a shape in which walls of the region 116 may diverge from one another. But, as illustrated in FIG. 5, this divergence may be limited to an amount that is merely sufficient to provide a width of an outlet 116-4 of the region 116 that may be about equal to a diameter of inlets 118-2 of the pipes 118. In other words, a smooth gas flow transition may be provided in which only minimal gas turbulence is produced. This desirable configuration may be achieved by selecting the angle A so that the honing tool 24 produces the inlet 118-2 in a shape of a hole with an outer edge 118-2-2 adjacent the shroud 114-4.

The transition-region backplane 115-2 may be incorporated directly onto the backplate 115. Consequently, the compressor 100 may be constructed with a part count that is no greater than that of the compressor 10 of FIG. 1, i.e., the compressors 10 and 100 may each be constructed with a single diffuser and a single backplate. In other words the compressor 100 may be produced at a cost that is no greater than a cost of production of the prior art compressor 10.

Figure 10:
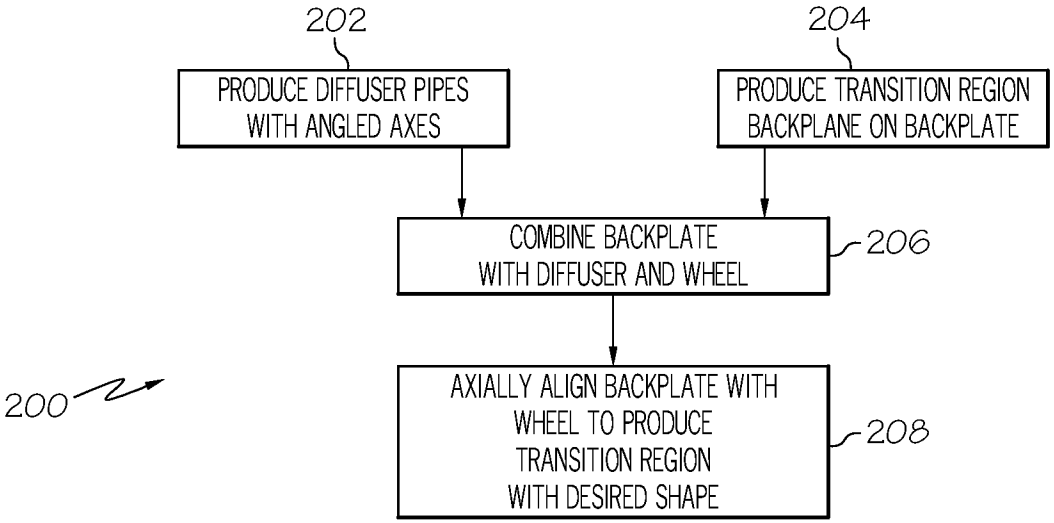
FIG. 10 is a flow chart of a method for constructing a centrifugal compressor in accordance with an embodiment of the present invention.

In one embodiment of the present invention, a method is provided for constructing a centrifugal compressor. In that regard, the method may be understood by referring to FIG. 10. In FIG. 10, a flow chart may portray various aspects of a method 200. In a step 202, a pipe diffuser may be produced with pipes having angled axes (e.g., the pipes 118 may be produced with the honing tool 24 oriented at an angle A relative to a plane 119 that is orthogonal to an axis 100-2 of the compressor 100). In a step 204, a backplane of a transition region may be formed on a backplate (e.g., the backplane 115-2 of the transition region 116 may be formed on the backplate 115). In a step 206, the backplate and the diffuser may be combined with a wheel to produce a compressor assembly (e.g., the wheel 112, the diffuser 114 and the backplate 115 may be assembled on the axis 100-2). In a step 208, the backplate may be axially aligned with the wheel and the diffuser to produce a transition region of a desired shape (e.g., the backplate 115 may be shimmed axially to produce the transition region 116 with a width of the outlet 116-4 that is about the same as a diameter of an inlet 118-2).

It should be understood, of course, that the foregoing relates to exemplary embodiments of the invention and that modifications may be made without departing from the spirit and scope of the invention as set forth in the following claims.

We claim:

1. A centrifugal compressor comprising:

a wheel;

a diffuser comprising:

an annular pipe diffuser section;

at least one cylindrical hole passing through the annular pipe diffuser section for compressing gas emerging from the wheel;

the at least one cylindrical hole having an axis that is slanted at an angle A relative to a plane that is orthogonal to an axis of rotation of the compressor, and a transition region between the wheel and an inlet of the hole, wherein a plurality of walls of the transition region diverge.

2. The compressor of claim 1 wherein the diffuser comprises a plurality of the holes.

3. The compressor of claim 1 wherein the diffuser further comprises a shroud formed integrally with the annular pipe diffuser section.

4. The compressor of claim 3:

wherein the hole has an inlet diameter;

wherein the angle A is large enough to allow passage of a cylindrical object through the hole without contacting the shroud; and wherein the cylindrical object has a diameter at least as great as the inlet diameter of the hole.

5. The compressor of claim 4 further comprising:

a backplate, wherein the transition region is bounded by the shroud and a backplane;

wherein the backplane is formed on the backplate; and wherein the backplate is not formed integrally with the diffuser.

6. The compressor of claim 5 wherein the transition region has a diverging shape which enlarges in a direction of gas flow.

7. The compressor of claim 6 wherein a width of the transition region does not exceed the inlet diameter of the hole so that only minimal gas turbulence is produced.

8. The compressor of claim 1 wherein the hole is tapered.

9. The compressor of claim 1 wherein an edge of the hole is adjacent to the shroud.

10. A method for producing a centrifugal compressor comprising the steps of:

producing pipes in an annular pipe diffuser, having an integral shroud, so that axes of the pipes slant at an angle A relative to a plane that is orthogonal to an axis of the compressor;

positioning the pipe diffuser around a wheel;

wherein a portion of the shroud forms a first boundary of a transition region between the wheel and the annular pipe diffuser, wherein the first boundary is free of any indentations resulting from the step of producing the pipes; and forming a transition region between the wheel and the diffuser, wherein a plurality of walls of the transition region diverge.

11. The method of claim 10 further comprising the step of forming a transition-region backplane on a backplate.

12. The method of claim 11 further comprising the step of positioning the backplate adjacent the wheel so that the transition-region backplane forms a second boundary of the transition region.

13. The method of claim 12 further comprising the step of axially aligning the backplate with the shroud to produce the transition region in a configuration in which an outlet width of the transition region is no larger than inlet diameters of the pipes.

14. The method of claim 10 wherein the pipes are formed with a tapered shape.

15. The method of claim 14 wherein the step of producing pipes comprises honing inner surfaces of the pipes.

16. The method of claim 15 wherein the step of producing the pipes comprises allowing a honing tool to project beyond inlets of the pipes during honing.

17. A method for producing a pipe diffuser for a centrifugal compressor comprising the steps of:

producing an annular diffuser integrally with a shroud, wherein at least one cylindrical hole passes through the annular diffuser; and positioning the pipe diffuser around a wheel;

forming a transition region between the wheel and an inlet of the hole, wherein a plurality of walls of the transition region diverge;

producing pipes through the annular diffuser with axes of the pipes slanted relative to a plane that is orthogonal to an axis of the compressor and so that the pipes are produced without producing tool marks on the shroud.

18. The method of claim 17 wherein the step of producing pipes comprises honing inner surfaces of the pipes.

19. The method of claim 18 wherein the step of producing the pipes further comprises extending a honing tool beyond inlets of the pipes.

20. The method of claim 19 wherein the step of producing the pipes further comprises producing the inlets so that edges of the inlets are adjacent to the shroud.

* * * * *